US007293722B1

(12) United States Patent
Srinath et al.

(10) Patent No.: US 7,293,722 B1
(45) Date of Patent: Nov. 13, 2007

(54) METHOD AND APPARATUS FOR GENERATION OF LOW IMPACT SPRAYS

(75) Inventors: Dharapuram N. Srinath, Ellicott City, MD (US); Surya Raghu, Ellicott City, MD (US); Gregory A. Russell, Baltimore, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 1107 days.

(21) Appl. No.: 10/016,131

(22) Filed: Dec. 17, 2001

Related U.S. Application Data

(63) Continuation-in-part of application No. 09/417,899, filed on Oct. 14, 1999, now Pat. No. 6,253,782, and a continuation-in-part of application No. 09/457,316, filed on Dec. 9, 1999, now Pat. No. 6,186,409.

(60) Provisional application No. 60/256,470, filed on Dec. 20, 2000.

(51) Int. Cl.
*B05B 1/08* (2006.01)

(52) U.S. Cl. ..... 239/589.1; 239/468; 239/472

(58) Field of Classification Search ..... 239/589.1, 239/461–497
See application file for complete search history.

(56) References Cited

U.S. PATENT DOCUMENTS

| | | | | |
|---|---|---|---|---|
| 3,614,961 | A * | 10/1971 | Nekrasov et al. | 181/142 |
| 4,205,786 | A * | 6/1980 | Babich et al. | 239/404 |
| 4,463,904 | A | 8/1984 | Bray, Jr. | 239/284 R |
| 4,508,267 | A | 4/1985 | Stouffer | 239/11 |
| 6,186,409 | B1 | 2/2001 | Srinath | 239/1 |
| 6,253,782 | B1 | 7/2001 | Raghu | 137/14 |

* cited by examiner

*Primary Examiner*—Christopher Kim
(74) *Attorney, Agent, or Firm*—Jim Zegeer

(57) ABSTRACT

In many applications where it is desired to distribute a liquid onto a surface at a very small angle of incidence, it will be necessary to reduce the momentum of the droplets to prevent ricochet off the surface. Obvious methods such as using a restrictor, reducing the operating pressure, etc. are not satisfactory due to the inadequate flow, susceptibility to clogging, etc.

3 Claims, 2 Drawing Sheets

METHOD AND APPARATUS FOR GENERATION OF LOW IMPACT SPRAYS

REFERENCE TO RELATED APPLICATION

This application is the subject of provisional application Ser. No. 60/256,470 filed Dec. 20, 2000 entitled GENERATION OF LOW IMPACT SPRAYS.

This application is a continuation-in-part of application Ser. No. 09/417,899 filed Oct. 14, 1999 for FEEDBACK FREE FLUIDIC OSCILLATOR AND METHOD, now U.S. Pat. No. 6,253,782 and a continuation-in-part of application Ser. No. 09/457,316 filed Dec. 9, 1999, NOZZLES WITH INTEGRATED OR BUILT-IN FILTERS AND METHOD, now U.S. Pat. No. 6,186,409.

BACKGROUND AND BRIEF DESCRIPTION OF THE INVENTION

The invention relates to a method and apparatus for generating low impact sprays, and more particularly to fluidic oscillator systems useful in liquid dispersal applications to efficiently distribute liquid in a controlled manner and in which ricochet of spray droplets from a surface is reduced and/or minimized.

Fluidic oscillators are used in many liquid dispersal applications to efficiently distribute the liquid in a controlled manner. In some of these applications, the spray is aimed at a very small angle of incidence to the surface on which the liquid is being distributed. One example is in vehicles in the rear window washer upon which it is desired to distribute liquid for cleaning purposes. Rear window washers generally need to have a wide output pattern to cover the entire wipe area. One feature of recent car designs is that the rear windows have curving tops. The curvature makes it difficult to aim the spray into the glass surface appropriately to distribute the liquid without causing overspray or ricochet of high velocity droplets from the glass surface. Both of the above effects result in wash fluid being wasted by delivering it to areas outside the glass.

One approach to solving this aiming problem is to reduce the velocity of the spray droplets so that they do not bounce off the glass surface. Traditional methods do not give an optimum solution, as described in the matrix below.

| | Description of Attempted Solution | Disadvantage |
|---|---|---|
| (1) | Raise the aim relative to glass. | Overspray. |
| (2) | Reduce the velocity by decreasing operating pressure. | Pressure has to be decreased significantly enough, resulting in not enough cleaning fluid being delivered. |
| (3) | Reduce the velocity by restrictor in the nozzle. | Increased chances of clogging. |
| (4) | Increase the nozzle size. | Physical limitations and too much flow rate. |
| (5) | Increase nozzle heights. | Unwieldy size -- nozzle easy to dislodge. |

The object of the present invention is to provide a solution while providing adequate flow rate and proper velocity. According to the present invention, a number of different ways to generate the required low velocity sprays while keeping a reasonable nozzle profile are disclosed.

According to one method, a multiple power nozzle oscillator of the type in which the disclosed in FIG. 8 of Raghu U.S. Pat. No. 6,253,782 issued Jul. 3, 2001 combined with the bilevel filter arrangement shown in Srinath et al U.S. Pat. No. 6,186,409.

Still another embodiment of the invention takes the form of the bilevel reversing chamber oscillator shown in FIGS. 6A and 6B of the aforementioned Srinath et al U.S. Pat. No. 6,186,409.

Yet another embodiment of the invention employs a vortex valve to increase the resistance to inlet flow and a multiple power nozzle-type fluidic oscillator.

In yet a further embodiment and to show the versatility of the invention, the invention can use a conventional fluidic oscillator with control passages of the type disclosed in Stouffer U.S. Pat. No. 4,508,267, coupled with a vortex valve; or a conventional wall attachment, feedback type oscillator as disclosed in Bray U.S. Pat. No. 4,463,904; coupled with a vortex valve pressure reducer.

The method of the invention involves producing low energy spray droplets which are more adapted to adhere to a surface. A fluidic spray nozzle is connected to a source of liquid under pressure, and the velocity of the sprayed droplets issuing from the fluidic spray nozzles is reduced so that the spray droplets do not bounce off of the surface. The invention allows the design of the liquid spray with the following advantages:

(1) Large flow channels decrease the possibility of clogging, compared to restrictors.

(2) Including a filter as illustrated in the reversing chamber circuit as an example will allow the nozzle to remain functional even if there are particulates in the flow.

(3) The invention allows for adequate flow rates for the intended purpose, such as rear window washing in cars, under low temperature environments.

(4) Controlled distribution of the liquid allows for delivering the liquid to the desired area without overspray or bouncing off the surface.

(5) The invention allows wide spray angles to be designed to cover large areas, without bouncing off the surface.

The invention features the following:

A fluidic spray system for producing low momentum liquid droplets comprising in combination, a fluidic oscillator coupled to a supply of liquid under pressure and a vortex valve immediately upstream of said fluidic oscillator.

A fluidic spray system for producing a liquid spray in which the spray droplets have a low momentum and allows wide angle sprays to be delivered to a selected surface area without bouncing off of said selected surface, comprising, a fluidic oscillator connectable by a flow path reverser to a source of liquid under pressure and wherein said fluidic oscillator is selected from a multiple power nozzle oscillator, a reversing chamber oscillator, and a feedback oscillator, and including a non-restrictor pressure reducer upstream of said fluidic oscillator.

Optionally, the non-restrictor pressure reducer is a vortex valve.

The fluidic spray nozzle includes a first and second two-sided molded chip having a fluidic oscillator formed in the first side and a feed circuit formed in the second side, and reducing pressure by feeding liquid from the first side to the second side, and said flow reverser reversing the direction of liquid flow thereof.

A fluidic spray system for producing a liquid spray in which the spray droplets have a low momentum and allows substantially unrestricted flows to be delivered to a point of utilization on a surface comprising a fluidic oscillator having an input coupled to a supply of liquid under pressure and a vortex valve immediately upstream of the fluidic oscillator, the vortex valve having an output which is connected to the input of the fluidic oscillator.

A fluidic oscillator spray system for producing a liquid spray in which the spray droplets have a low momentum and allows for producing droplets of larger diameters and a narrower range of diameters for similar operating pressures.

The invention also features a method for producing low energy spray droplets which are adapted to adhere to a surface comprising, providing a fluidic spray nozzle connectable to a source of liquid under pressure, reducing the velocity of spray droplets issuing from the fluidic spray nozzle so that the spray droplets do not bounce off the surface.

The fluidic spray nozzle is selected from the following:

(a) low frequency multiple power nozzle oscillator, (b) a filter and reversing chamber oscillator, (c) a vortex chamber feeding a fluidic oscillator.

The fluidic spray nozzle includes a first and second two-sided molded chip having a fluidic oscillator formed in the first side and a feed circuit formed in the second side, and reducing pressure by feeding liquid from the first side to the second side, and reversing the direction of liquid flow thereof.

The object of the invention is to provide an improved fluidic spray system in which the liquid droplets have a low momentum and larger diameter and a narrower range of diameters so that the liquid droplets do not bounce off of a surface and/or the liquid droplets are more adapted to adhere to a surface.

DESCRIPTION OF THE DRAWINGS

The above and other objects, advantages and features of the invention will become more apparent when considered with the following specification and accompanying drawings wherein.

DETAILED DESCRIPTION OF THE INVENTION

The operation of the different oscillators is disclosed in the aforementioned Raghu U.S. Pat. No. 6,253,782, Srinath et al U.S. Pat. No. 6,186,409, Stouffer U.S. Pat. No. 4,508,267 and Bray U.S. Pat. No. 4,463,904, all of which are incorporated herein by reference.

Figure 1:
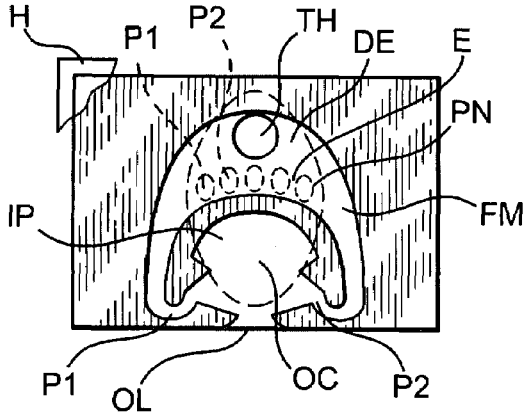
FIG. 1 is a plan view of a bilevel multiple power nozzle incorporating one embodiment of the invention.
Figure 2:
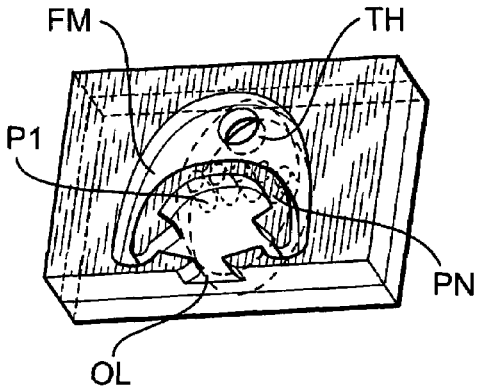
FIG. 2 is an isometric transparent material view thereof showing the silhouette components in full lines.
Figure 3:
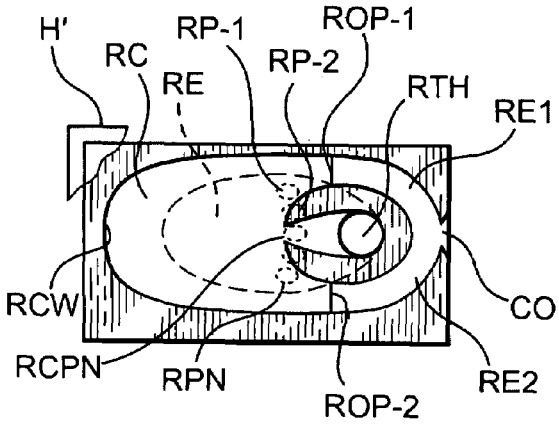
FIG. 3 is a embodiment of a reversing chamber oscillator of the type shown in FIGS. 6A and 6B of Srinath et al U.S. Pat. No. 6,186,409 in which the reversing chamber oscillator is on one level and the filter is on another level so that the liquid under pressure from a source goes through a direction reversal in traveling from the filter level to the reversing chamber oscillator level and also reversing direction in the reversing chamber and the liquid has to also travel through the downstream inertance extensions which terminate and merge at the outlet throat.
Figure 4:
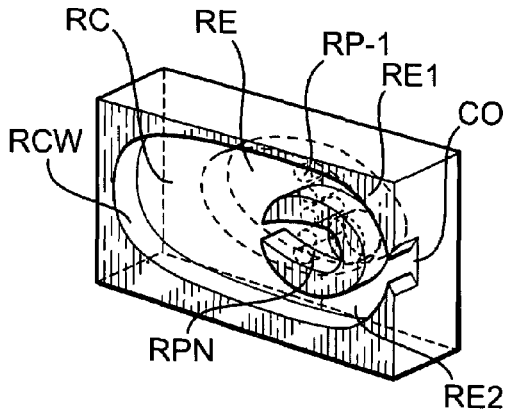
FIG. 4 is an isometric transparent material view thereof showing the silhouette components in full lines, FIG. 5 discloses a vortex valve configuration with a multiple power nozzle oscillator configuration.
Figure 5:
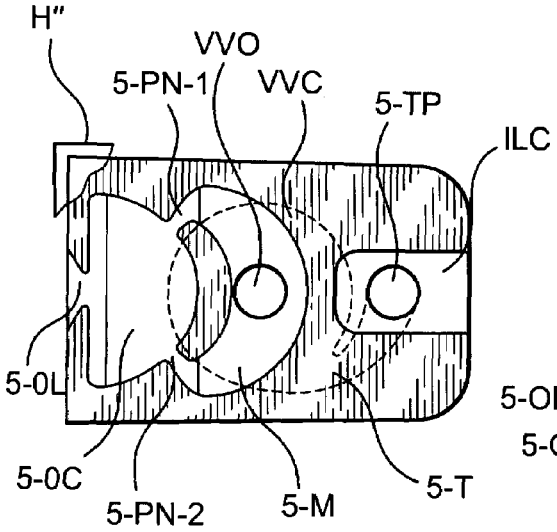
Figure 6:
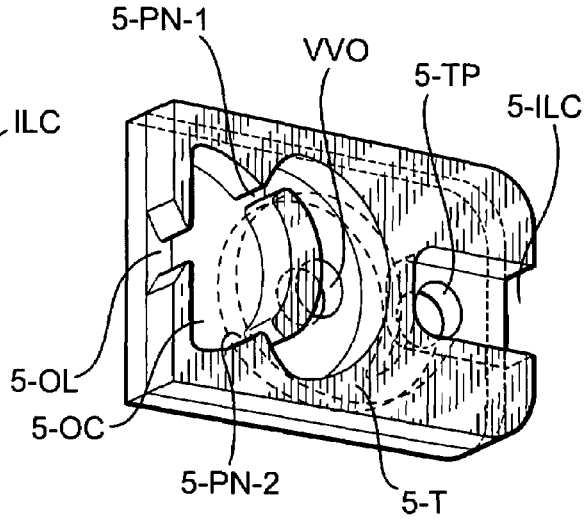
FIG. 6 is an isometric transparent material view thereof with the silhouette components in solid lines, FIG. 7 discloses a vortex valve combined with a fluidic oscillator nozzle of the type disclosed in Stouffer U.S. Pat. No. 4,508,267, and FIG. 8 discloses a vortex valve combined with a fluidic oscillator nozzle of the type disclosed in Bray U.S. Pat. No. 4,463,904.

FIGS. 1, 3 and 5, the full line element or silhouette is the fluidic oscillator involved, and the dash-line silhouette is the input structure that is formed on the reverse side thereof. FIGS. 2, 4 and 6 are illustrations of the embodiment shown in FIGS. 1, 3 and 5, respectively which both levels in full line, and the material in which the elements are formed is transparent. Each of the devices of FIGS. 1-6 have been shown in "chip" form as they come from an injection molder, for example. These elements are inserted into a housing H in FIG. 1, H' in FIG. 3, H" in FIG. 5, and H'" in FIG. 7 in FIG. 8.

In each of the embodiments, the input hole or aperture is aligned with an input barb (not shown) on the housing. Referring now to FIGS. 1 and 2, the input circuit, as shown in dashed lines, comprises an input passage IP having an enlargement E having a plurality of posts P1, P2 . . . PN spaced thereacross with the spacing being of the size relative to the enlargement E to trap clogging particles without impeding the flow of liquid, should there be any clogging particles trapped in the spaces. The downstream end DE of the enlargement E has a through-passageway or aperture TH which couples in a reversed flow direction to the feed manifold FM (of a multiple power nozzle-type oscillator). In FIG. 1, input liquid first flows up in input passage IP through the filter post P1, P2 . . . PN area through aperture TH and then down through manifold FM.

The multiple power nozzle has a pair of power nozzles P1, P2 which project a pair of fluid oscillator jets into the oscillation chamber OC and at least one outlet OL issues a pulsating or oscillating jet of liquid to a point of utilization on a surface or ambient. The two liquid jets or streams are properly sized and oriented in the oscillation chamber or interaction region OC such that the resulting flow pattern is a system of vortices that is inherently unstable and cause the two jets to cyclically change their direction. This produces a sweeping jet at the exit or outlet OL of the oscillation chamber OC.

In this embodiment, due to the fact that the power jet reverses its direction twice before exiting, the resulting spray will have relative low velocity. Thus, the requisite low velocity spray is developed while keeping a reasonable nozzle profile.

Referring now to FIGS. 3 and 4, a reversing chamber-type oscillator is shown and which is fed via integrally molded feed enlargement RE having spaced posts RP-1, RP-2 . . . RP-N which are spaced are predetermined distances so as to trap small particles which would tend to clog the power nozzle RPN of the reversing chamber oscillator. Downstream of the posts RP-1, RP-2 . . . RP-N is a throughhole RTH which feed liquid to the reversing chamber power nozzle RCPN. In FIG. 3, it should be noted that the illustration of filter posts are in the opposite level or opposite side of the "chip" from the power nozzle and is not in the power nozzle. The power nozzle RCPN issues a jet of fluid or liquid into the reversing chamber RC and which impacts on reversing chamber wall RCW and sets up a system of vortices which alternately block and unblock output passages ROP-1, ROP-2 with passageway extensions or inertances RE-1, RE-2 leading to a common outlet CO. As in the case with the multiple power nozzle oscillator described in connection with FIGS. 1 and 2, the power liquid in this instance goes through a first reversal at throughhole RTH and a second reversal in the chamber RC and also has to travel through downstream inertance tubes or outlet extensions RE-1, RE-2 which terminate in the throat of common outlet CO. The result is a low-frequency oscillation of the jet with a good flow rate and coverage.

FIGS. 5 and 6 disclose yet another embodiment, in which a vortex valve in conjunction with various types of fluidic oscillators, the one shown in this embodiment is a multiple power nozzle fluidic oscillator of the type disclosed in Raghu U.S. Pat. No. 6,253,782. The vortex valve is shown in dash-lines on the opposite chip side of the multiple power nozzle fluidic oscillator. In this embodiment, the input liquid channel ILC is formed on the oscillator side of the "chip" is fed to the vortex valve by a first throughpassage 5-TP which supplies a tangential input nozzle 5-T driving the vortex valve chamber VVC which has an output VVO which is through a throughpassage coupling to the power nozzle manifold 5-M. Power nozzles 5-PN-1 and 5-PN-2 project a pair of liquid jets into the oscillation chamber 5-OC. There is at least one outlet 5-OL. In operation, the pair of liquid jets issuing from the power nozzles 5-PN-1 and 5-PN-2 interact such that they generate a plurality of vortices in the chamber 5-OC and the plurality of vortices cause the pair of liquid jets to cyclically change their direction and combine to produce a sweeping jet of liquid at the outlet. It is obvious that the combination of a vortex valve for dropping the pressure of a liquid driving a fluidic oscillator results in, each case, being a reduction in the momentum of the liquid droplets produced by the oscillation of the liquid jet issuing from the outlet of the fluidic oscillator.

Figure 7:
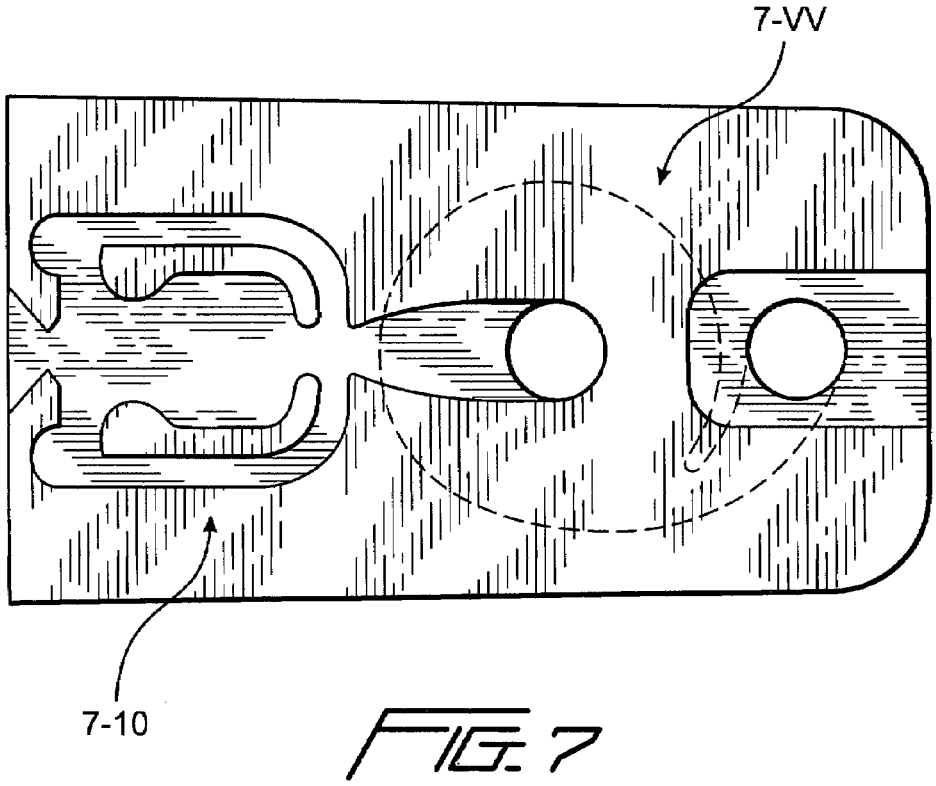
Figure 8:
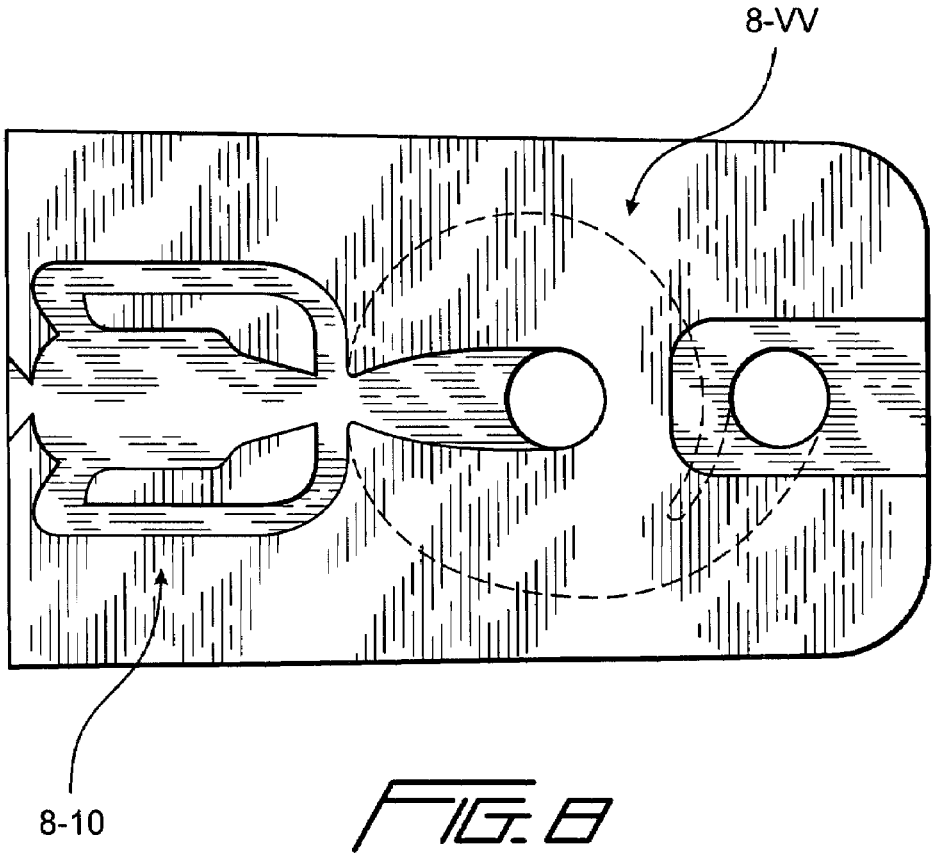

In FIG. 7, fluidic oscillator 7-10 of the type disclosed in Stouffer U.S. Pat. No. 4,508,267 is combined with a vortex valve 7-VV to provide a fluidic spray system which projects low momentum liquid droplets of larger diameter in a narrower range of diameters. Similarly, in FIG. 8, a fluidic oscillator 8-CO, of the type disclosed in Bray U.S. Pat. No. 4,463,904, is combined with a vortex valve 8-VV as a pressure reducer with similar results. The cold performance features of the Bray patent may be utilized herewith.

To recap, the invention provides large flow channels which decrease the possibility of clogging compared to restrictors. The droplets have low momentum, are of larger diameter, and are in a narrower range of diameters for similar operating pressure. The filter included with the reversing allows the nozzle to remain functional even if there are particulates in the flow while providing a flow path reverser. The invention allows for adequate flow rates for various purposes, such as rear window washing of cars under low-temperature environments. The invention provides controlled distribution of liquid and allows for delivering the liquid to the desired area without overspray or bouncing off the surface. The invention allows wide spray angles be designed to cover large areas without bouncing off the surfaces. Finally, the invention provides a solution of providing adequate flow rates and proper velocity of fluid sprays for certain unique situations such as described earlier herein.

While the invention has been described in relation to preferred embodiments of the invention, it will be appreciated that other embodiments, adaptations and modifications of the invention will be apparent to those skilled in the art.

What is claimed is:

1. A liquid spray in which the spray droplets have a momentum which allows spray droplets to be delivered to a selected surface area without said spray droplets bouncing off of said selected surface, comprising, a fluidic oscillator connected to a source of liquid under pressure and wherein said fluidic oscillator is selected from:

(a) a multiple power nozzle oscillator, (b) a reversing chamber oscillator, and (c) a feedback oscillator, and a non-restrictor pressure reducer upstream of said fluidic oscillator, and wherein said non-restrictor pressure reducer is a vortex valve.

2. A fluidic spray system for producing a liquid spray in which the spray droplets have a momentum such that said spray droplets do not bounce on impacting a surface and allows substantially unrestricted flows to be delivered to a point of utilization on said surface comprising a fluidic oscillator having an input coupled to a supply of liquid under pressure and a vortex valve immediately upstream of said fluidic oscillator, said vortex valve having an output which is connected to the input of said fluidic oscillator.

3. A fluidic oscillator spray system comprising a fluidic oscillator and non-restrictor pressure reducing means coupling said oscillator to a source of liquid for producing a liquid spray in which the spray droplets have a momentum and allows for producing droplets of larger diameters and a selected range of diameters for similar operating pressures.

* * * * *